US009920595B2

(12) United States Patent
Leiper

(10) Patent No.: US 9,920,595 B2
(45) Date of Patent: Mar. 20, 2018

(54) WELLBORE FILTRATION TOOL WITH NOVEL WIPER CUP

(71) Applicant: Odfjell Well Services Norway AS, Tananger (NO)

(72) Inventor: Simon Leiper, Dubai (AE)

(73) Assignee: Odfjell Well Services Norway AS, Tananger (NO)

( * ) Notice: Subject to any disclaimer, the term of this patent is extended or adjusted under 35 U.S.C. 154(b) by 239 days.

(21) Appl. No.: 14/860,911

(22) Filed: Sep. 22, 2015

(65) Prior Publication Data

US 2016/0362963 A1 Dec. 15, 2016

Related U.S. Application Data

(60) Provisional application No. 62/175,618, filed on Jun. 15, 2015.

(51) Int. Cl.
*E21B 37/02* (2006.01)
*E21B 17/10* (2006.01)

(52) U.S. Cl.
CPC ..... *E21B 37/02* (2013.01); *E21B 17/10* (2013.01)

(58) Field of Classification Search
CPC ..... E21B 17/10; E21B 37/02
See application file for complete search history.

(56) References Cited

U.S. PATENT DOCUMENTS 1,371,792 A * 3/1921 Kirk ..... B08B 9/0436 15/104.17
2,157,493 A * 5/1939 Miller ..... E21B 37/02 15/104.069
4,515,212 A * 5/1985 Krugh ..... E21B 27/00 166/170
6,250,387 B1 * 6/2001 Carmichael ..... E21B 21/002 166/229
2009/0283330 A1 * 11/2009 Lynde ..... E21B 21/002 175/316

FOREIGN PATENT DOCUMENTS

WO WO2009009456 1/2009
WO WO2011149668 12/2011

* cited by examiner

*Primary Examiner* — James G Sayre
(74) *Attorney, Agent, or Firm* — Brett A. North

(57) ABSTRACT

The present invention provides wellbore cleaning tool and method featuring a wiper assembly which allows fluid to bypass the tool in one direction while diverting the well fluid through a filter screen in another direction. This may be achieved by either circulation of the fluid in the wellbore or by moving the tool relative to the fluid in the wellbore. The wiper assembly includes multiple groups or series of wiper elements wherein one petal shaped element aligns with a slot to form a seal when the tool body is retrieved from the well.

19 Claims, 11 Drawing Sheets

WELLBORE FILTRATION TOOL WITH NOVEL WIPER CUP

CROSS-REFERENCE TO RELATED APPLICATIONS

This application claims benefit of U.S. Provisional Patent Application Ser. No. 62/175,618, filed Jun. 15, 2015, which is incorporated herein by reference and to which priority is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the removal of debris from oil and gas wells. More particularly, the present invention relates to an improved method and apparatus for removing debris from an oil and gas well tubular or tube shaped member or pipe (e.g., casing) wherein the apparatus employs specially configured petals and slots that enable flow outside the tool body in both up and down directions.

2. General Background of the Invention

In general, the removal of debris from oil and gas wells is well documented. There are many examples of prior art which include scrapers and brushes to mechanically clean the interior surface of casing of the well. Likewise, there are examples of tools designed to remove the debris from the wellbore after it has been scraped and/or brushed. This is an important function of a wellbore cleanup operation as the removal of junk and debris help mitigate against failure of downhole equipment, particularly when circulation of wellbore fluid alone is insufficient to ensure hole cleaning. Magnets are often used for this purpose, however not all wellbore debris is ferrous. Therefore, some debris must be removed by a mechanical means.

Some prior art devices (e.g., see U.S. Pat. No. 6,250,387) use a wiper cup made of a flexible but high strength rubber, typically supported by metal wires which are moulded into the rubber. The rubber and wire work together to provide sealing and wiping capability as well as resistance to tearing. One problem with this type of device is that the wiper cup is adapted from use as a one directional seal whereby fluid pressure on the inside of the cup bellows the cup outwards to create a seal.

Fluid pressure on the outside of the cup causes it to partially collapse, allowing pressure to bypass the cup. The wiper cup can hold pressure in only one direction. It cannot allow significant volumes of fluid or debris laden fluid to flow past it in the opposite direction, particularly the volumes required to perform an effective wellbore cleanup. This is due to the shape of the cup which form a continuous seal on the inside of the wellbore, as well as the materials used which while being rubberized are still relatively stiff and resilient in order to be robust enough to work in a downhole environment.

In order to allow the high volume of debris laden fluid to pass the tool, the device of U.S. Pat. No. 6,250,387 discloses a series of check valves. This allows fluid to pass through the tool in one direction bypassing the filter, and works in conjunction with the wiper cup to divert fluid through the screen in another direction. The check valves which act as a diversion means for the filtered fluid often become blocked by larger debris and junk resulting in the wellbore fluid partially or completely bypassing the filter and therefore rendering the tool useless. The wire wrapped screen used on this device is prone to damage whereby junk becomes trapped in the annular volume between the screen and the casing. Due to rotation of the tool, the wire screen can become damaged and fail catastrophically.

The largest external components are used for stand-off and are attached such that they rotate with the tool. It is commonly accepted that wellbore cleanup tools which feature non-rotating centralizers (centralizers which can remain stationary while the tool rotates) prevent casing and tool wear. The 'burst disks' used on the U.S. Pat. No. 6,250,387 as an emergency bypass are prone to opening accidentally which allows partial or complete bypass of the filter, which occurs most often when the drilling rig 'pumps a slug' (a method of lowering the fluid level in the wellbore by placing an artificially high density pill into the work-string which over-pressures the burst disk).

SUMMARY

In one embodiment, the present invention provides an improved wellbore (e.g., tubular casing) cleaning and filtration tool. The present invention addresses the issues of wiping the casing and filtering the wellbore fluid of debris while being removed from the well.

The apparatus of the present invention is structurally comprised of a top "sub" (i.e., short length of pipe or tubular) and a mandrel which are mated together via an internal connection (e.g., threaded) to form a tool body. The tool body provides an open ended axial bore running throughout its length. An upper connection is provided on the top "sub" and a lower connection on the bottom of the mandrel. The upper and lower connections are employed to connect the tool body to a conventional drill string. A wiper assembly on the tool body separates an upper annulus from a lower annulus. The tool body includes a debris chamber as defined by a perforated filter screen and filter shroud located on the mandrel. The tool body also features a centralizer ring to prevent damage to the apparatus while downhole. This ring can be the largest non-flexible outer diameter (O.D.) surface of the tool body.

During use, the apparatus is connected to the drill string and lowered into the wellbore. The wiper assembly is slightly larger than the internal diameter of the wellbore (i.e., casing) so as to cause an interference between to wipe the internal wall of the wellbore while the tool body is lowered into the well.

The wiper assembly consists of a series of overlapping wiper elements. Each wiper component can be a petal or petal shaped member. The wiper elements include a non-flexible backing ring made of steel or other metal to which is bonded a flexible wiper petal ring made of a flexible wiper compounds (e.g., rubber, polymer) such that the two pieces form a composite part. The external surfaces of the ring and wiper petal ring can be tapered so as to bias the wiper petal ring to deform in one direction while preventing it from deforming in another direction.

There are a series of circumferentially spaced apart slots which extend longitudinally through the backing ring and wiper petal ring. The petals and slots are so positioned that when the wiper elements are stacked together all the petals of a lower wiper element can deform and form a reasonably tight fit with the slot of the wiper element immediately above it. The petals are circumferentially spaced apart. As an example, there can be ten (10) petals spaced thirty-six degrees apart for a first wiper ring or group. The next, adjacent wiper ring or group could also have ten (10) petals spaced thirty six (36) degrees apart. However, the petals of the first group are spaced circumferentially eighteen degrees from the petals of the second group. In this fashion, gaps between petals of the first group align with petals of the second group. A third group of petals aligns with the gaps of the second group.

Each wiper element can be stacked on and bonded to a wiper inner sleeve and arranged so that each group or series of petals and slots form an interlocking pattern whereby when fluid passes in one direction the petals can retract fully inside the slots of the wiper element immediately above it, and also that when fluid flows in an opposite direction that the interlocking petals form a rudimentary seal which largely prevent fluid from passing in the opposite direction. While this invention discloses a composite part consisting of multiple stacked elements, it is also possible to manufacture the wiper assembly by using a single moulding.

Whilst tool is lowered into the wellbore, debris laden fluid passes from the lower annulus to the upper annulus and outside the perforated filter screen and past the outside of the wiper assembly which deforms to a collapsed position in the manner described. An axial bore allows for pumping of chemicals and fluids to assist in cleaning the well.

When the tool body is removed from the wellbore, the wiper assembly wipes the internal wall of the wellbore. The petals prevent debris from passing around the wiper assembly and diverts debris laiden fluid from the upper annulus through fluid entry ports/courses and into the debris chamber. A perforated filter screen traps the debris in the debris chamber while at the same time allowing filtered/clean fluid to pass through the perforated filter screen and the filter shroud to the outside of the tool body and exit into the lower annulus.

In the event that the debris chamber fills completely, a pressure differential is created between the debris chamber and the lower annulus which causes the bypass valve to open enabling fluid to drain from the upper annulus to the lower annulus, bypassing the perforated filter screen.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

Figure 1:
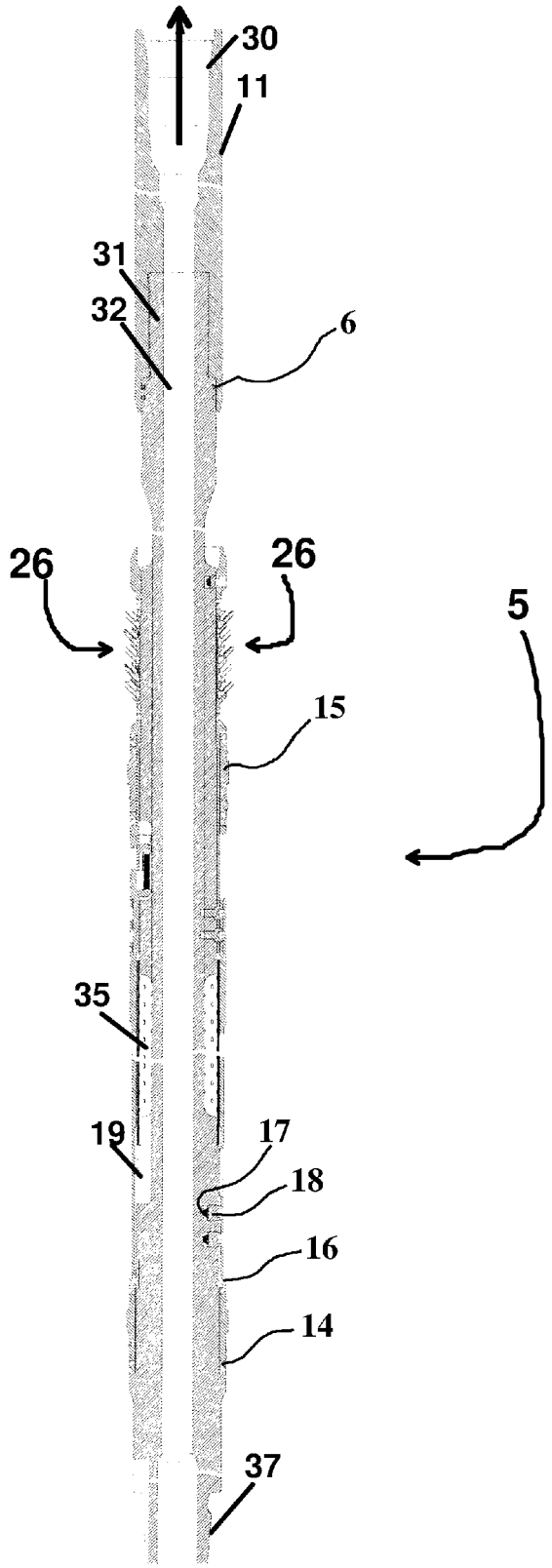
FIG. 1 is a longitudinal, sectional view of a preferred embodiment of the present invention.

The apparatus of the present invention is designated generally by the numeral 5. Apparatus 5 provides an elongated tool comprised of a top sub 11 and of a mandrel 12 which are mated together via an internal connection 31. Top "sub" 11 is simply a short length of pipe or tubular materials. Such "subs" are known and commercially available. The tool body 6 features an open ended axial bore 32 running through out its length. Tool body 6 has an upper connection 30 on the top sub 11 and a lower connection 37 on the mandrel 12.

The upper and lower connections 30 and 37 are employed to connect the tool body 6 to a conventional drill string. Wiper assembly 26 separates upper annulus 33 from the lower annulus 36. The tool body 6 includes a debris chamber 35 having perforated filter screen 19 and filter shroud 20 located over the mandrel 12. The tool body 6 also features non-rotating, contact, centralizer ring 15 to prevent damage to the tool while downhole. This is the largest non-flexible OD (outer diameter) surface of the tool body 6. In order to clean bore 10, the tool body 6 is connected to a drill string and lowered into the wellbore 10.

An o-ring 200 can be placed at the connection 31. Centralizer bearing ring 15 is mounted to the outside of tool body 6 in between wiper assembly 26 and debris chamber 35. Bearing ring 14 is mounted to tool body 6 in between debris chamber 35 and lower connection 37. Tool body 6 includes split ring 16, conical spring 17 and back out bolt 18.

In one embodiment apparatus 5 can include wiper assembly 26. The identifiers ', ", '", and "" are used to indicate items of substantially the same construction, but of a different piece.

In one embodiment, the wiper assembly 26 consists of a series or groups of wiper groups 28, 28', 28", 28'", and 28"". In one embodiment each wiper group 28 can include a flexible wiper petal ring 39 and a relatively non-flexible backup ring 38. In one embodiment flexible petal ring 39 can have a plurality of circumferentially spaced apart wiper elements.

The flexible petal rings 39, 39', 39", 39'", and 39"" can be mounted next to relatively non-flexible backing rings 38, 38', 38", 38'", and 38"" which can be made of steel or other metal. The flexible petal rings 39, 39', 39", 39'" can be made of rubber or other flexible compounds. The non-flexible backing rings 38, 38', 38", 38'", and 38"" can be respectively bonded to the flexible petal rings 39, 39', 39", 39'", and 39"" such that each of the respective set of two pieces form a composite part.

The external surfaces of the backing rings 38 and wiper petal rings 39 can be tapered so as to bias each wiper petal ring 39 to deform in one direction while preventing it from deforming in another direction.

Each petal ring 39 can have a plurality of circumferentially spaced apart wiper elements (e.g., petal rings 39, 39', 39", 39'", and 39"" respectively each having plurality of wiper elements 45, 46, 47, 48) which wiper elements can be in the shape of a petal 44. There can be spaces or slots 43 between each pair of wiper elements (see FIGS. 8-9 and 12-13).

There can be a series of slots 43 which extend longitudinally through the plurality of backing rings 38, 38', 38", 38'", and 38"" and wiper petal rings 39, 39', 39", 39'", and 39"" which are patterned circumferentially. Each petal ring 39 thus includes alternating petals 44 and slots 43. The width of the slots 43 are only slightly larger than the width of the petal 44 such that when the wiper elements 45, 46, 47, and 48 are stacked together all the petals 44 of a lower wiper ring can deform and form a reasonably tight fit with the slot 43 of the wiper ring immediately above it.

Figure 7:
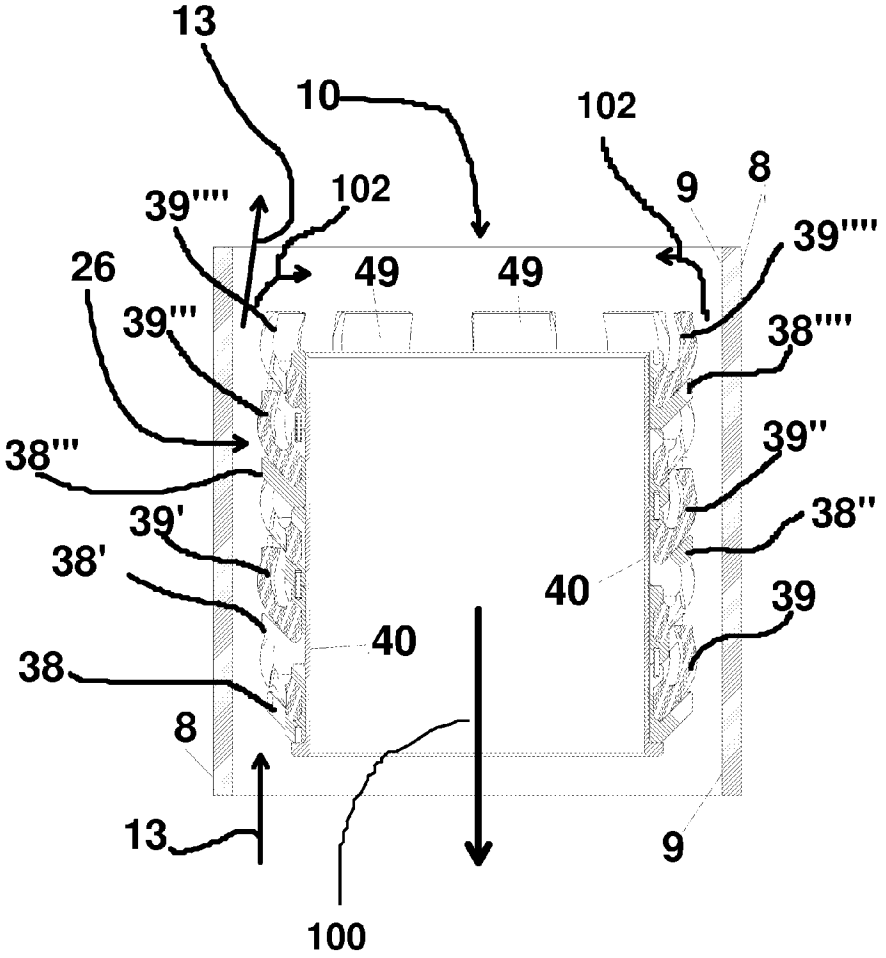
FIG. 7 is a sectional view taking through lines 7-7 of FIG. 6.
Figure 6:
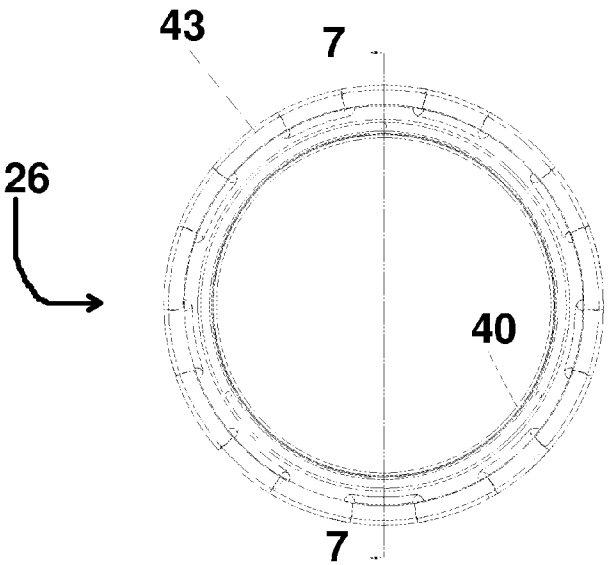
FIG. 6 is a sectional view taking through lines 6-6 of FIG. 3.
Figure 8:
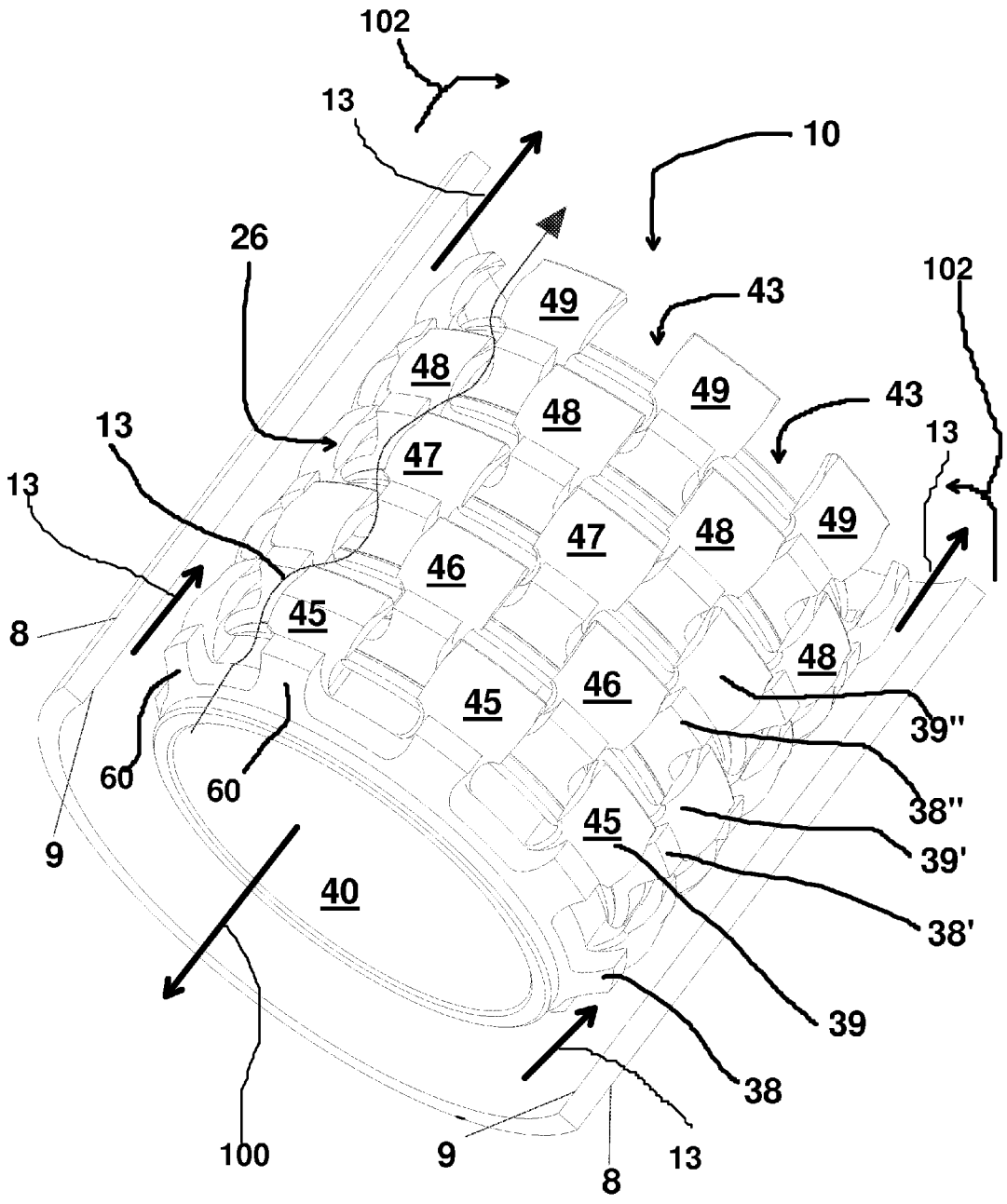
FIG. 8 is an enlarged perspective view of the embodiment of FIG. 2 schematically illustrating flow around the embodiment of FIG. 1 during lowering, and showing the wiper assembly in a retracted condition.
Figure 9:
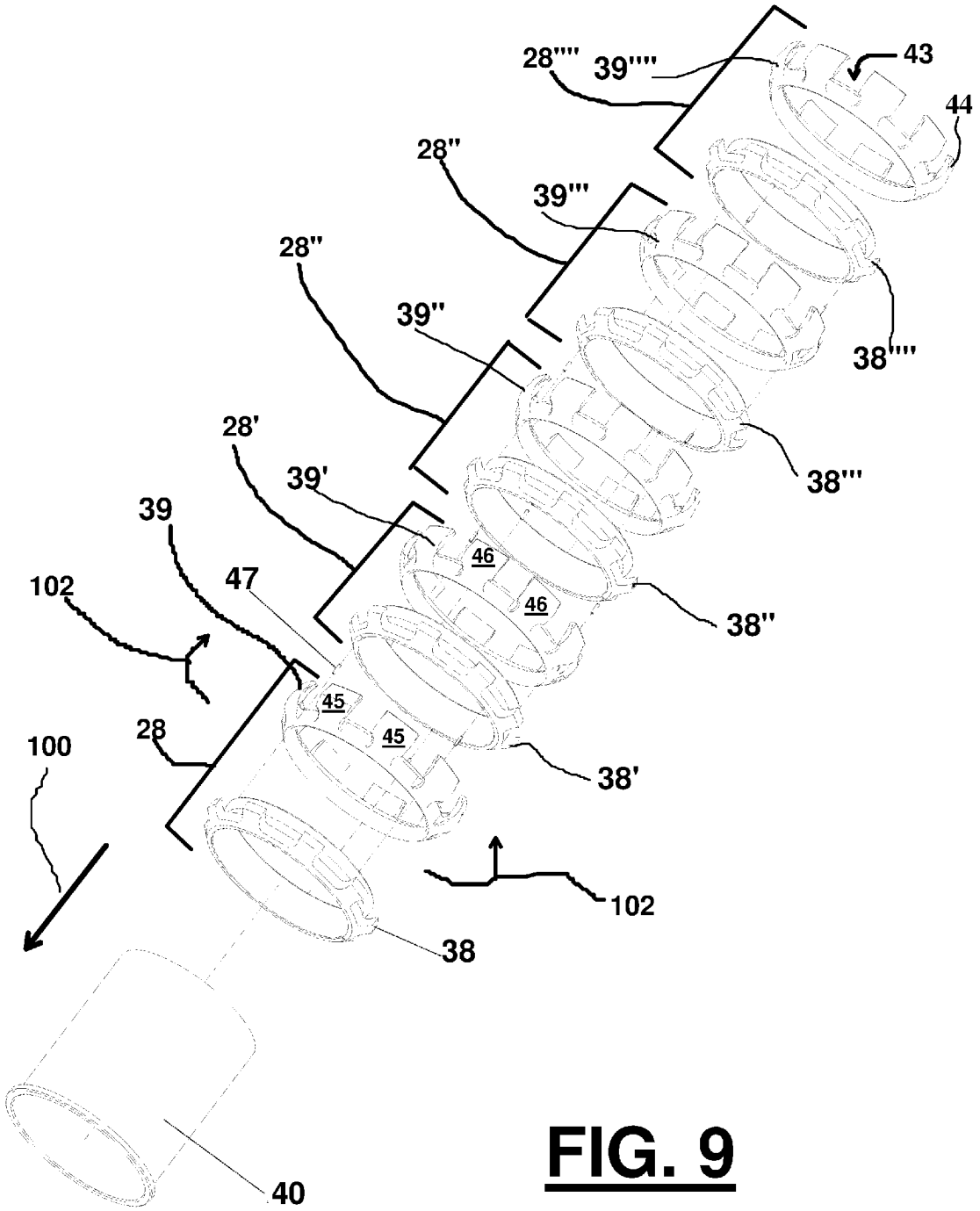
FIG. 9 is an exploded perspective view of the embodiment of FIG. 2 schematically illustrating the condition for flow during lowering, and showing the wiper assembly in a retracted condition, and showing the plurality of wiper rings and wiper elements making up the wiper assembly.

Each wiper element (e.g., sets of wiper elements 45, 46, 47, 48) can be stacked on and bonded to a wiper inner sleeve 40 and arranged so that each group or series of petals 44 and slots 43 form an interlocking pattern whereby when fluid passes in one direction the wiper elements 45, 46, 47, and 48 can retract fully inside the slots 43 of the wiper element immediately above it (respectively wiper elements 45 into 46, 46 into 47, and 47 into 48—see FIGS. 7-9). When fluid flows in an opposite direction (e.g., schematically shown be arrows 21) the interlocking petals 44 form a rudimentary seal which largely prevents fluid from passing in the opposite direction (see FIGS. 4,5, and 11-13).

Each backup ring 38 can have a plurality of circumferentially spaced apart backup prongs 60 which can be located immediately below one of the respective wiper elements to provide backup up support to the respective wiper element when the apparatus 5 is being pulled up (schematically indicated by arrow 110). Additionally the spaced apart backup prongs 60 can be spaced such that wiper elements of a lower backup ring can fit between the gaps in the backup prongs 60 of the next located upper backup ring (see FIG. 8).

While the present invention discloses a composite part consisting of multiple stacked wiper groups 28, 28', 28", 28'", 28"", it is also possible to manufacture the wiper assembly 26 by using a single moulding.

Figure 2:
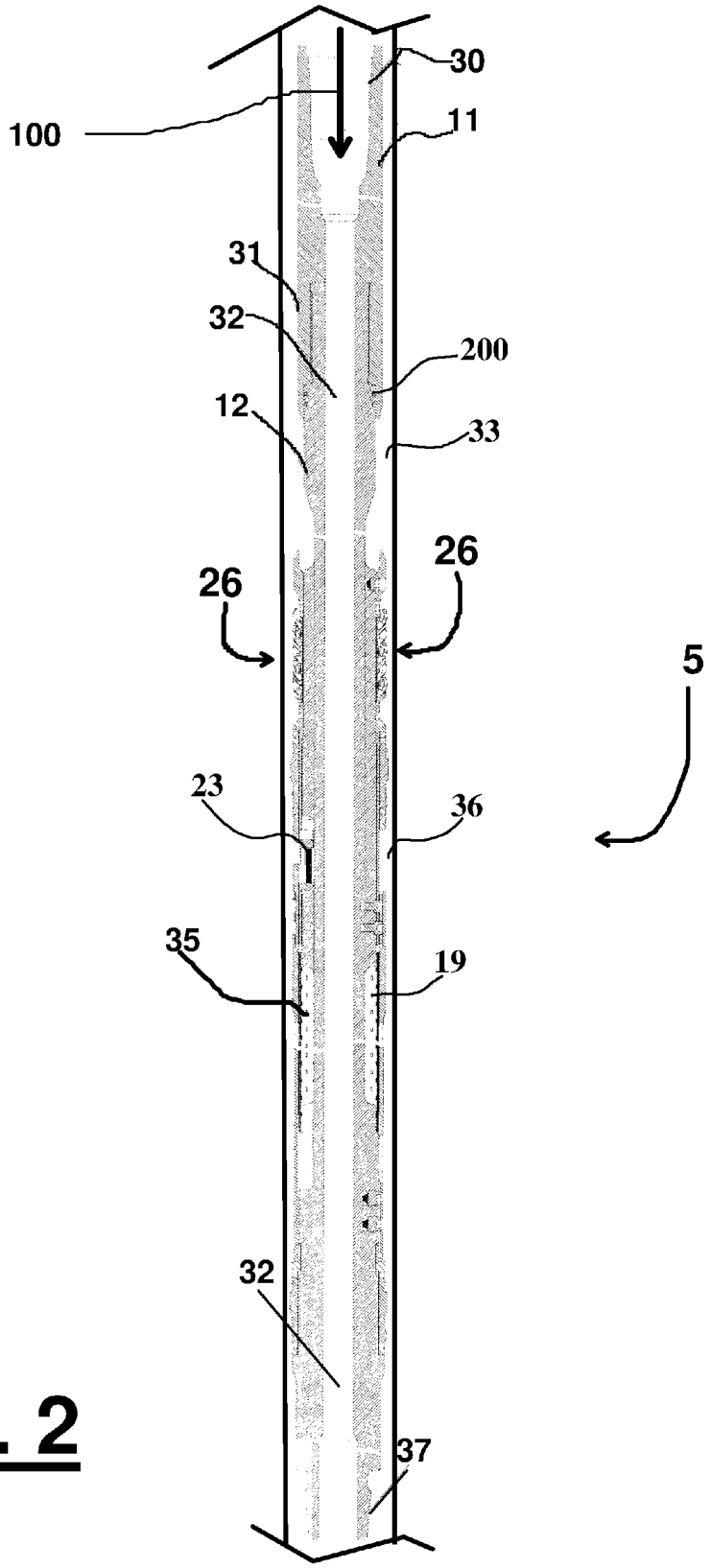
FIG. 2 is longitudinal, sectional view of the embodiment shown in FIG. 1 being lowered, and showing the wiper assembly in a retracted condition.
Figure 3:
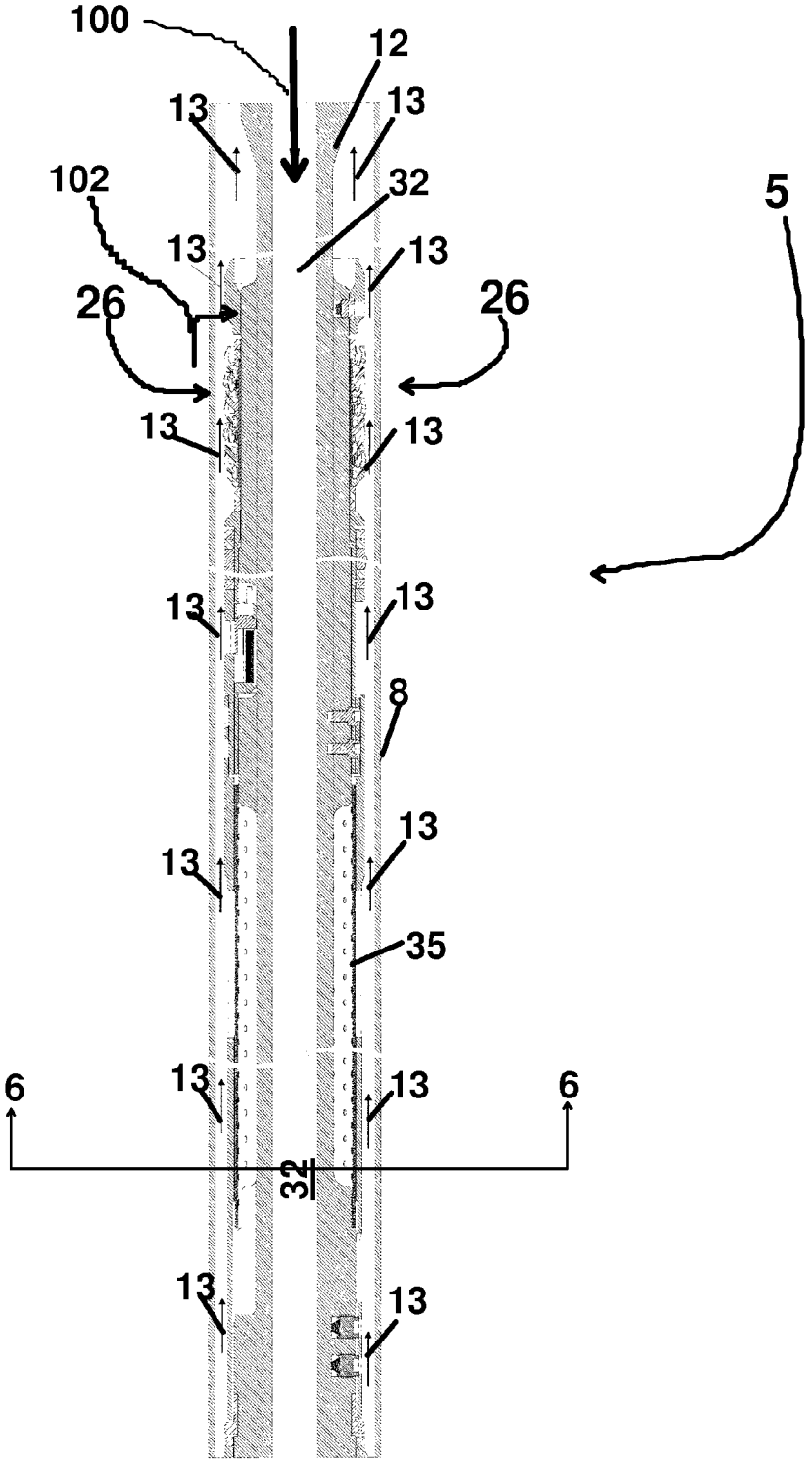
FIG. 3 is an enlarged sectional view of FIG. 2 schematically illustrating flow around the embodiment of FIG. 1 during lowering, and showing the wiper assembly in a retracted condition.

As schematically shown in FIGS. 2 and 3, while tool body 6 is lowered into the wellbore 10 (schematically indicated by arrow 100), debris laden fluid passes from lower annulus 36 to upper annulus 33 outside the perforated filter screen 19 and past the outside of wiper assembly 26 (see arrows 13, FIGS. 3,7, and 8) which deforms in the manner described to a collapsed position. Arrows 102 in FIG. 7 schematically indicate that, as apparatus 5 is lowered in the direction of arrow 100, the wiper elements of wiper assembly 26 are placed in a retracted state by fluid flow relative to wiper assembly in direction of arrow 13.

In one embodiment, the wiper assembly 26 can be slightly larger than the internal wall of the wellbore 10 so as to cause an interference between the two, and wipe the internal wall 9 of the wellbore 10 while the apparatus 5 is lowered into the wellbore 10.

Figure 4:
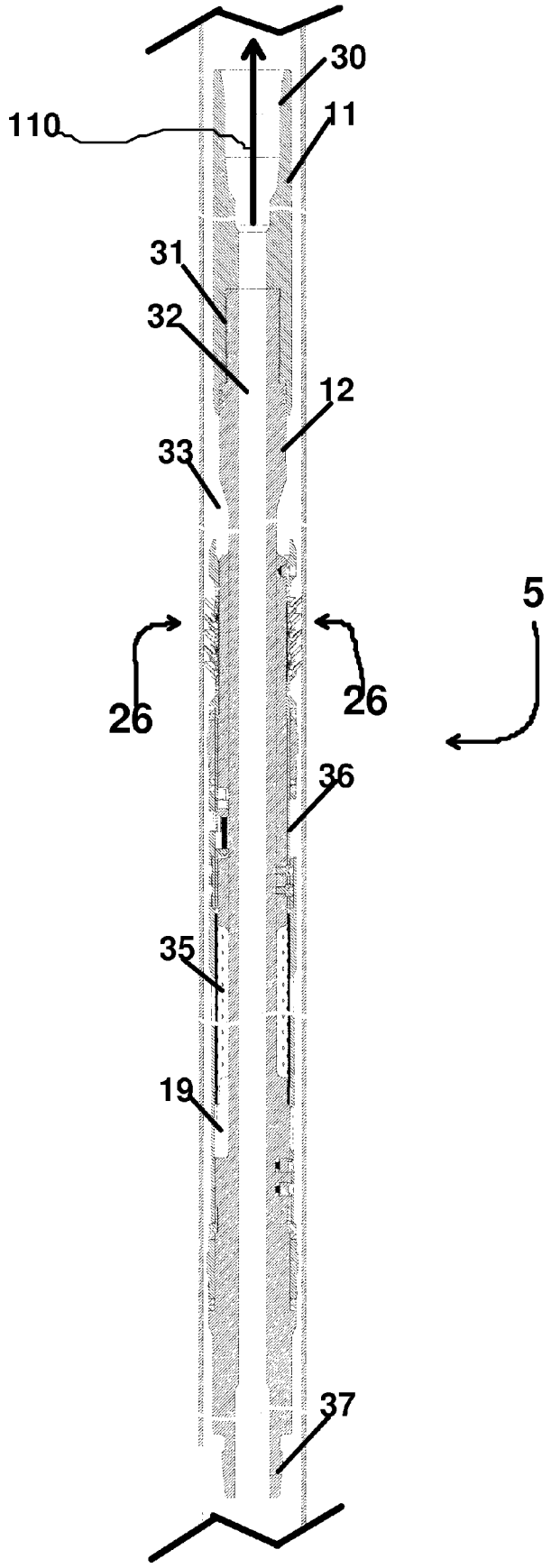
FIG. 4 is longitudinal, sectional view of the embodiment shown in FIG. 1 being raised, and showing the wiper assembly in an extended condition.
Figure 5:
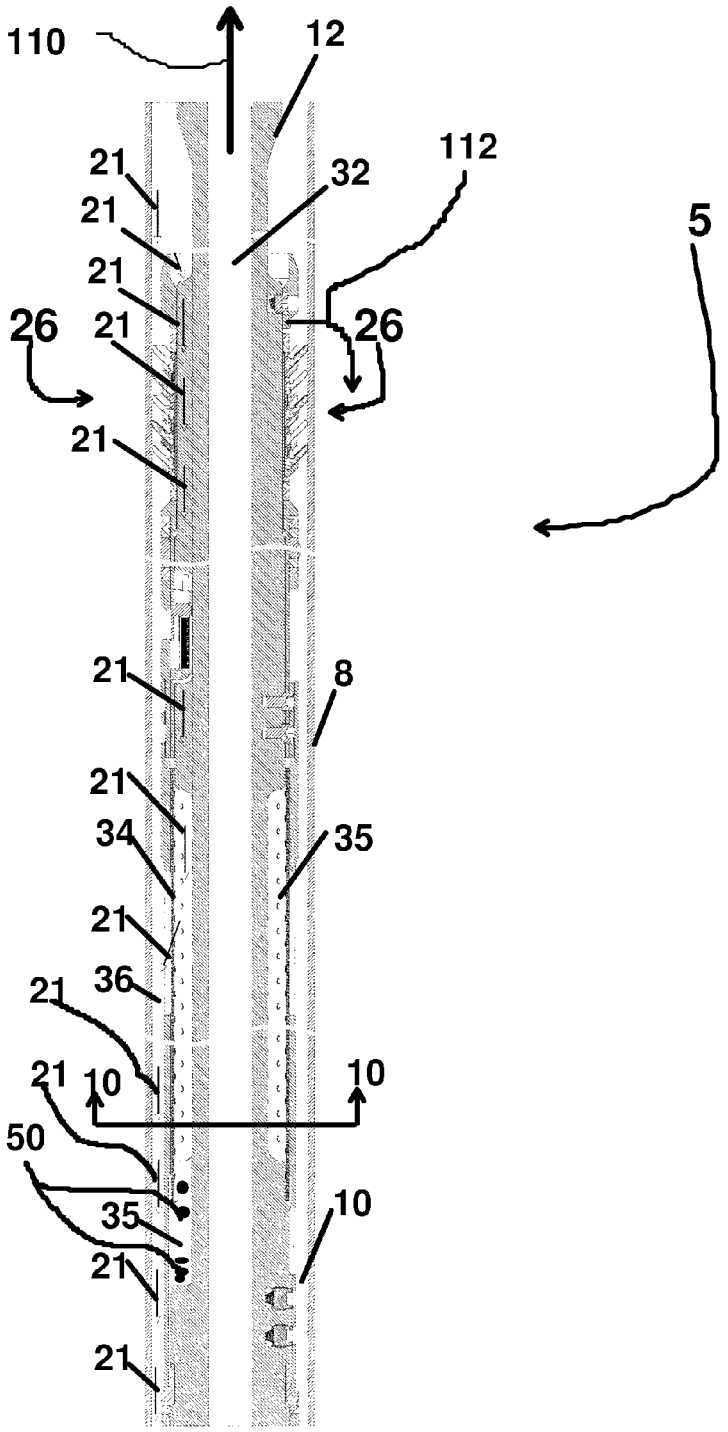
FIG. 5 is an enlarged sectional view of FIG. 4 schematically illustrating flow through the filtering system of the embodiment of FIG. 1 during raising, and showing the wiper assembly in an extended condition.
Figure 11:
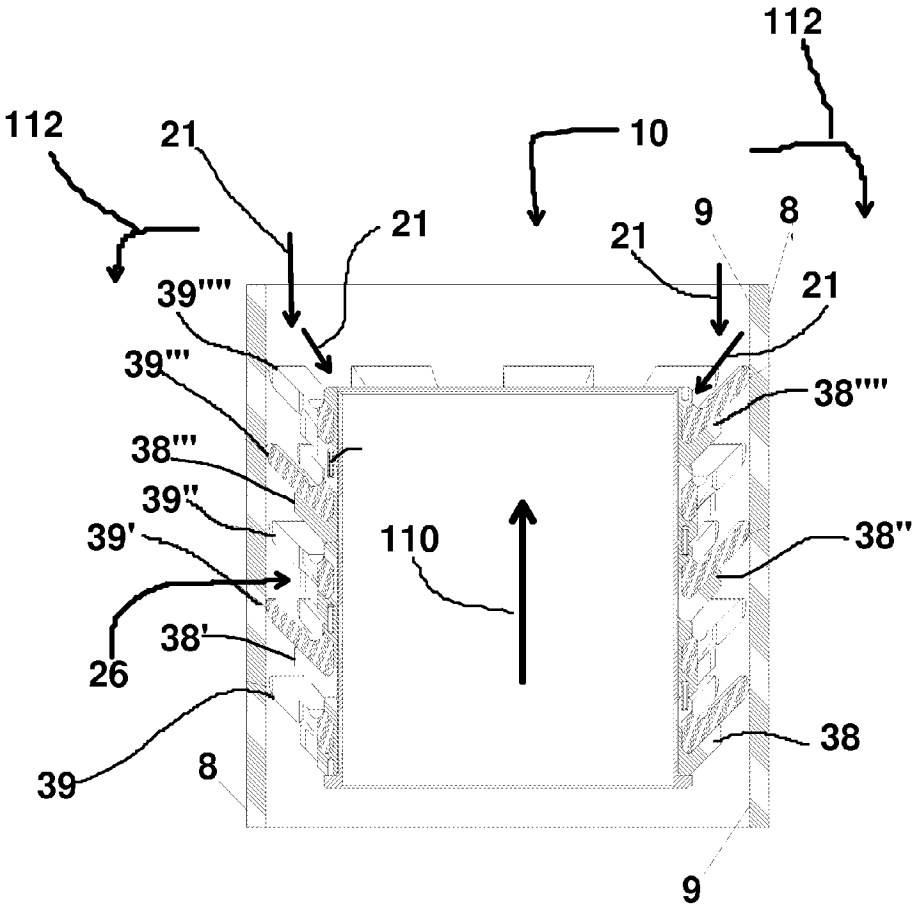
FIG. 11 is a sectional view taking through lines 11-11 of FIG. 10.
Figure 10:
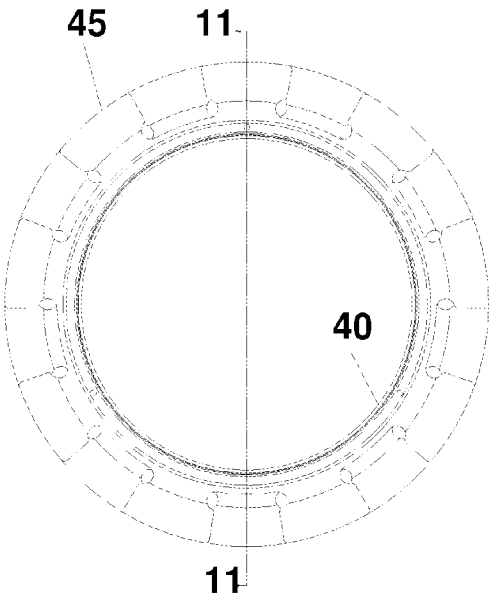
FIG. 10 is a sectional view taking through lines 10-10 of FIG. 5.
Figure 12:
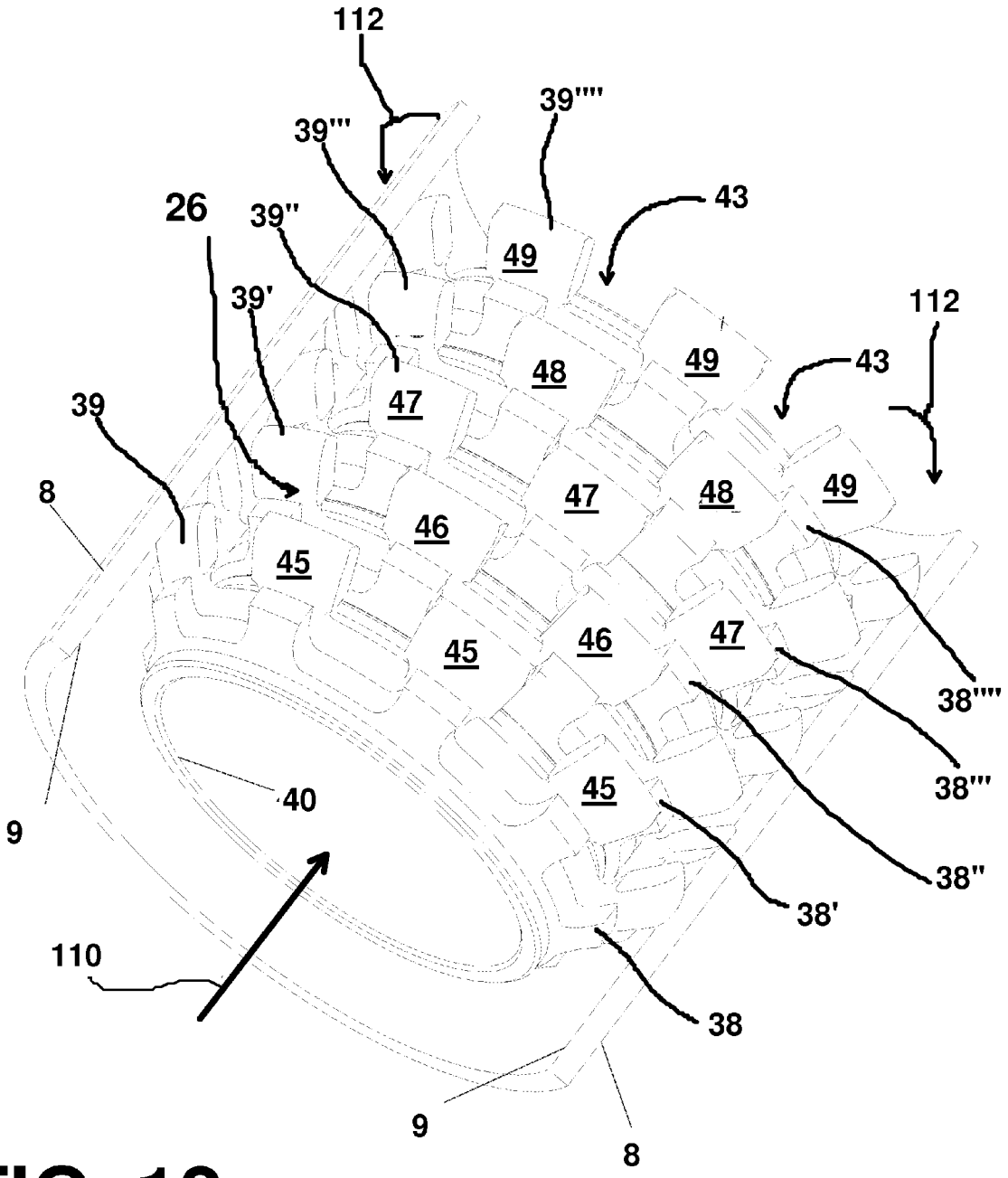
FIG. 12 is an enlarged perspective view of the embodiment of FIG. 4 schematically illustrating flow through the filtering system during raising, and showing the wiper assembly in an extended position.
Figure 13:
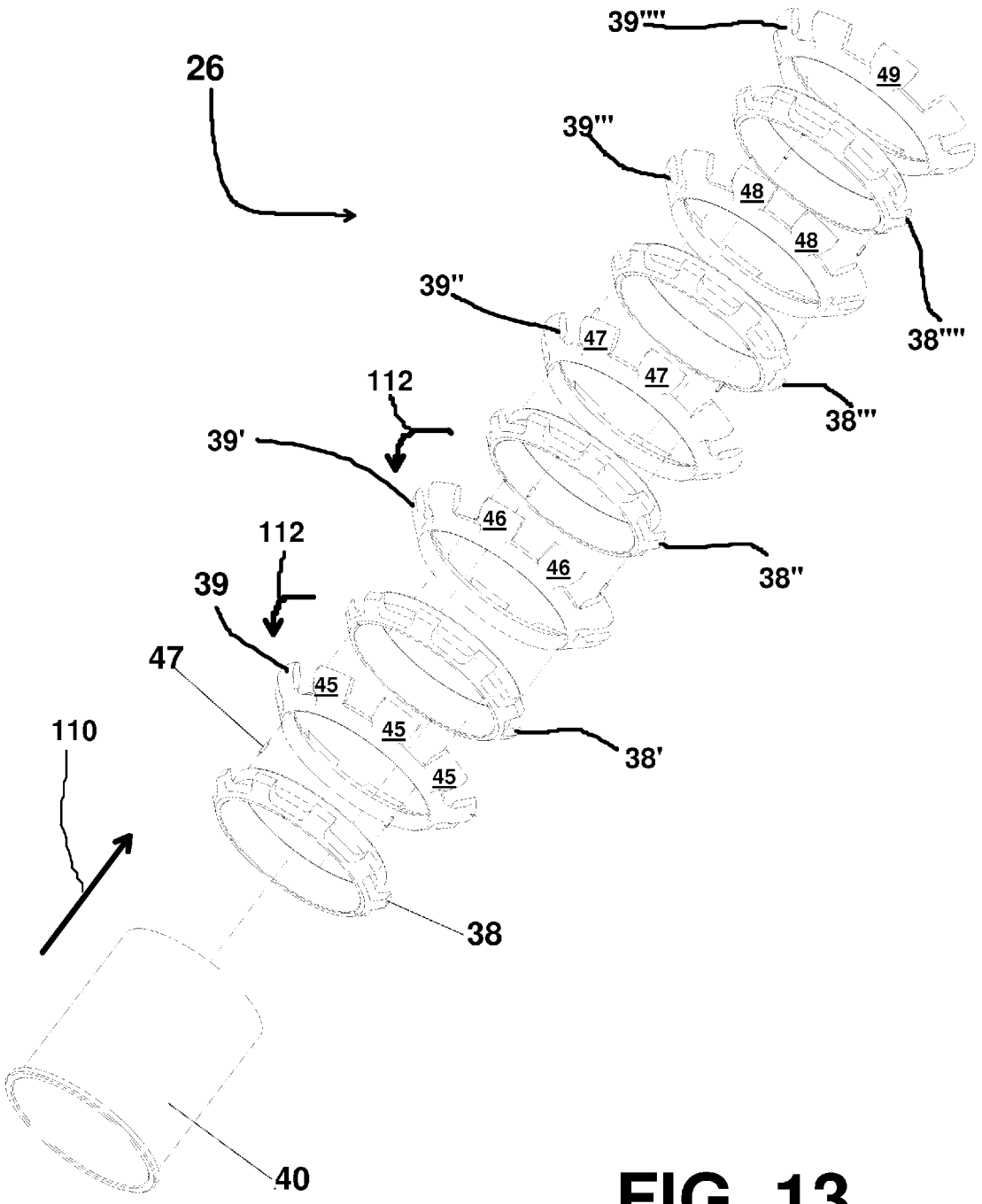
FIG. 13 is an exploded perspective view of the embodiment of FIG. 4 schematically illustrating flow through the filtering system during raising, and showing the wiper assembly in an extended condition, and showing the plurality of wiper rings and wiper elements making up the wiper assembly.

As schematically shown in FIGS. 4 and 5, when the tool body 6 is removed from the wellbore 10 (schematically indicated by arrow 110), the wiper assembly 26 wipes the internal surface or internal wall 9 of the wellbore 10. The wiper elements 45, 46, 47, and 48 prevent debris from passing around the wiper assembly 26 and diverts debris laiden fluid from the upper annulus 33 through the fluid entry ports/courses 34 (see arrows 21, FIG. 5) and into the debris chamber 35 (see arrows 21, FIG. 5) which collects the filtered out debris 50. Arrows 112 in FIG. 11 schematically indicate that, as apparatus 5 is raised in the direction of arrow 110, the wiper elements of wiper assembly 26 are placed in an extended state by fluid flow relative to wiper assembly in direction of arrow 21.

The perforated filter screen 19 traps the debris 50 in chamber 35 while at the same time allowing filtered/clean fluid to pass through the perforated filter screen 19 and the filter shroud 10 and exit into the lower annulus 36.

In one embodiment, axial through bore 32 allows for pumping of chemicals and fluids to assist in cleaning the well during the process of lowering (arrow 100) and/or raising (arrow 110) apparatus 5.

In one embodiment can be included a bypass valve 23 for the debris chamber 35. In the event that the debris chamber 35 fills completely, the a pressure differential is created between the debris chamber 35 and the lower annulus 26 which causes the bypass valve 23 to open and the fluid to drain from the upper annulus 33 to the lower annulus 26, bypassing the perforated filter screen 19.

The following is a list of parts and materials suitable for use in the present invention:

PARTS LIST

| PART NUMBER | DESCRIPTION |
|---|---|
| 5 | apparatus |
| 6 | tool body |
| 8 | casing |
| 9 | inside surface/internal wall |
| 10 | wellbore |
| 11 | top sub |
| 12 | mandrel |
| 13 | arrow |
| 14 | arrow |
| 15 | centralizer ring |
| 19 | perforated filter screen |
| 20 | filter shroud |
| 21 | arrows |
| 23 | bypass valve |
| 26 | wiper assembly |
| 28 | wiper group |
| 30 | upper connection |
| 31 | internal connection |
| 32 | axial bore |
| 33 | upper annulus |
| 34 | fluid entry ports |
| 35 | debris chamber |
| 36 | lower annulus |
| 37 | lower connection |
| 38 | wiper backing ring |
| 39 | wiper petal ring |
| 40 | wiper inner sleeve |
| 41 | petal bonding location |

-continued

| PARTS LIST | |
|---|---|
| PART NUMBER | DESCRIPTION |
| 42 | fluid path |
| 43 | slots |
| 44 | petal |
| 45 | wiper element |
| 46 | wiper element |
| 47 | locking pin |
| 50 | collected debris |
| 100 | arrow |
| 102 | arrow |
| 110 | arrow |
| 112 | arrow |
| 200 | o-ring |

All measurements disclosed herein are at standard temperature and pressure, at sea level on Earth, unless indicated otherwise. All materials used or intended to be used in a human being are biocompatible, unless indicated otherwise. The foregoing embodiments are presented by way of example only; the scope of the present invention is to be limited only by the following claims.

The invention claimed is:

1. Apparatus for removing debris from a well bore, comprising:

a) a tool body having an outside surface, upper and lower end portions with connectors that enable connection of the tool body to a work string;

b) the tool body having an inner bore that enables fluid flow through the tool body and between said upper and lower end portions;

c) a debris chamber;

d) a wiper assembly mounted to the tool body in between and spaced apart from said upper end and lower end portions;

e) a channel that is in between the tool body outer surface and the tool body bore, said channel enabling fluid to flow from a position above the wiper assembly to said debris chamber;

f) a screen that enables fluid to exit the debris chamber wherein the screen retains debris;

g) wherein the wiper assembly includes a first plurality of circumferentially spaced apart petals and a first plurality of circumferentially spaced apart slots, each slot of the first plurality between two of said petals of the first plurality;

h) wherein the wiper assembly includes a second plurality of circumferentially spaced apart petals and a second plurality of circumferentially spaced apart slots, each slot of the second plurality placed in between two of said petals of the second plurality; and i) wherein petals of the first plurality are aligned longitudinally with slots of the second plurality so that when fluid flows on the outside of the tool body in a direction from the upper end portion to the lower end portion, the flow of fluid relative to the wiper assembly causes the petals of the first plurality to cover the slots of the second plurality and thereby form a seal to largely prevent fluid flow past the wiper assembly.

2. The apparatus of claim 1, wherein each petal of the first and second circumferentially spaced apart petals having expanded and retracted states and being flexible, and further including a plurality of non-flexible backup members such that each petal has a corresponding non-flexible backup member located immediately below its respectively petal such that the respective backup member limits the maximum expansion by its respective petal in moving to the respective petal's expanded state.

3. The apparatus of claim 2, wherein the petals are mounted to an inner sleeve that is on the outside surface of the tool body, and the plurality of backup members are a plurality of circumferentially spaced apart prongs with a plurality of gaps between each of the circumferentially spaced apart prongs, and wherein the second plurality of circumferentially spaced apart petals, when in the retracted state, are fit into the gaps between the plurality of spaced apart prongs serving as backup members for their respectively petals of the first plurality of circumferentially spaced apart petals.

4. The apparatus of claim 3, further comprising a third plurality of circumferentially spaced apart petals and a third plurality of slots between the third plurality of circumferentially spaced apart petals, and a second plurality of backup members including a second plurality of circumferentially spaced apart prongs with a second plurality of gaps between each of the circumferentially spaced apart prongs of the second plurality of spaced apart prongs, and wherein the third plurality of circumferentially spaced apart petals, when in the retracted state, are fit into the gaps between the second plurality of spaced apart prongs serving as backup members for their respectively petals of the second plurality of circumferentially spaced apart petals.

5. The apparatus of claim 1, wherein the petals collapse toward the tool body enabling fluid flow along the outside surface of the tool body in a direction from the lower end portion to the upper end portion.

6. The apparatus of claim 1, wherein when the first and second plurality of circumferentially spaced part petals are in the expanded state said petals divert debris laden fluid from the channel and into the debris chamber.

7. The apparatus of claim 6, wherein the first and second plurality of circumferentially spaced apart petals are rubber and the external surfaces of the first and second plurality of circumferentially spaced apart petals are tapered to bias each petal to deform in a first direction while preventing it from deforming in a second direction.

8. The apparatus of claim 1, wherein the petals of the first plurality of circumferentially spaced apart petals have first and second edges, and the petals of the second plurality of circumferentially spaced apart petals also have first and second edges, and in the extended state the first edge of one petal in the first plurality of circumferentially spaced apart petals is generally parallel to the second edge of the next closest petal in the second plurality of circumferentially spaced apart petals.

9. The apparatus of claim 1, wherein the petals of the first plurality of circumferentially spaced apart petals each have a petal perimeter shape and size, and the slots between the second plurality of circumferentially spaced apart petals each have a slot perimeter shape and size, and in the extended state for the first and second plurality of circumferentially spaced apart petals, the petal perimeter shape and size generally matches the slot perimeter shape and size.

10. The apparatus of claim 1, wherein fluid flowing from the lower end portion to the upper end portion causes the first and second plurality of petals to enter into the retracted state.

11. The apparatus of claim 1, wherein the petals of the first and second plurality of circumferentially spaced apart petals each have top and bottom edges, and the top edge of each of the second plurality of petals in the retracted state is closely spaced to the bottom edge of at least one of the petals of the first plurality of petals.

12. A method of cleaning a wellbore tubular comprising the steps of:

a) providing a tool including i) a tool body having an outside surface, upper and lower end portions with connectors that enable connection of the tool body to a work string;

ii) the tool body having an inner bore that enables fluid flow through the tool body and between said upper and lower end portions;

iii) a debris chamber;

iv) a wiper assembly mounted to the tool body in between said upper end and lower end portions, and spaced apart from the upper and lower end portions;

v) a channel that is in between the tool body outer surface and the tool body bore, said channel enabling fluid to flow from a position above the wiper assembly to said debris chamber;

vi) a screen that enables fluid to exit the debris chamber wherein the screen retains debris;

vii) wherein the wiper assembly includes a first plurality of circumferentially spaced apart petals and a first plurality of circumferentially spaced apart slots, each slot of the first plurality between two of said petals of the first plurality;

viii) wherein the wiper assembly includes a second plurality of circumferentially spaced apart petals and a second plurality of circumferentially spaced apart slots, each slot of the second plurality placed in between two of said petals of the second plurality; and ix) wherein petals of the first plurality are aligned longitudinally with slots of the second plurality so that when fluid flows on the outside of the tool body in a direction from the upper end portion to the lower end portion, the petals of the first plurality cover the slots of the second plurality to form a seal to largely prevent fluid flow past the wiper assembly;

b) dowering a tool body on a pipe string into a well tubular having fluid laden with debris, wherein lowering the tool body relative to the well tubular causing the fluid laden with debris to flow relative to the tool body from its lower end to its upper end thereby causing the first and second plurality of petals to enter the retracted state;

c) after step "b", raising the tool body relative to the well tubular causing the fluid laden with debris to flow relative to the tool body from its upper end to its lower end thereby causing the first and second plurality of petals to enter into the extended state, and thereby causing the diversion of debris laden fluid from an annular space between the exterior surface of the tool body and an interior surface of the well tubular and into the debris chamber;

d) collecting the debris in the debris chamber.

13. The method of claim 12, wherein in step "a", each petal of the first and second circumferentially spaced apart petals being flexible and including a plurality of non-flexible backup members such that each petal has a corresponding non-flexible backup member located immediately below its respectively petal such that the respective backup member limits the maximum expansion by its respective petal in moving to the respective petal's expanded state.

14. The method of claim 13, wherein the plurality of backup members are a plurality of circumferentially spaced apart prongs with a plurality of gaps between each of the circumferentially spaced apart prongs, and wherein the second plurality of circumferentially spaced apart petals, when in the retracted state, are fit into the gaps between the plurality of spaced apart prongs serving as backup members for their respectively petals of the first plurality of circumferentially spaced apart petals.

15. The method of claim 13, wherein in step "c" wherein the petals of the first plurality of circumferentially spaced apart petals each have a first plurality petal perimeter shape and size, and the second plurality of circumferentially spaced apart slots each have a second plurality slot perimeter shape and size, and in the extended state for the first and second plurality of circumferentially spaced apart petals, the first plurality petal perimeter shape and size generally matches the second plurality slot perimeter shape and size.

16. The method of claim 12, wherein in step "c" there is a gap between each pair of petals and further comprising aligning each petal of the first plurality of circumferentially spaced petals with a gap between two petals of the second plurality of circumferentially spaced petals.

17. The method of claim 12, wherein the petals of the first and second plurality of circumferentially spaced apart petals each have top and bottom edges, and the top edge of each of the second plurality of petals in the retracted state is closely spaced to the bottom edge of at least one of the petals of the first plurality of petals.

18. A method of cleaning a wellbore tubular comprising the steps of:

a) lowering a tool body on a pipe string into a well, the tool body having upper and lower portions and a wiper assembly located between the upper and lower portions and spaced apart from the upper and lower portions;

b) wiping the tubular with the tool body;

c) wherein the wiper has expanded and retracted states, and is configured to enable fluid to flow pass the wiper in the retracted state externally of the tool body, the wiper being moved between retracted and expanded positions by different directions of external flow past the tool body;

d) wherein in step "c" the wiper includes a first plurality of circumferentially spaced apart wiper elements and a gap in between each pair of said wiper elements of the first plurality and a second plurality of wiper elements that are spaced longitudinally from said first plurality, wherein said wiper elements move between expanded and retracted positions;

e) closing each said gap with a wiper element of the second plurality in the expanded position forming a seal to largely prevent fluid flow past the wiper; and f) collecting the debris in a debris chamber on the tool body.

19. The method of claim 18, wherein the petals of the first and second plurality of circumferentially spaced apart petals each have top and bottom edges, and the top edge of each of the second plurality of petals in the retracted state is closely spaced to the bottom edge of at least one of the petals of the first plurality of petals.

* * * * *